United States Patent [19]

Yeomans

[11] Patent Number: 4,762,184

[45] Date of Patent: Aug. 9, 1988

[54] DIGGING POINT ASSEMBLY

[76] Inventor: Allan J. Yeomans, 30 Elizabeth St., Forbes, New South Wales, 2871, Australia

[21] Appl. No.: 904,187

[22] Filed: Sep. 5, 1986

[30] Foreign Application Priority Data

Dec. 19, 1985 [AU] Australia ..... 51485/85

[51] Int. Cl.[4] ..... A01B 15/06; A01B 23/02; A01B 39/22

[52] U.S. Cl. ..... 172/704; 37/142 R; 172/734; 172/753; 172/769; 172/772

[58] Field of Search ..... 37/141, 141 T, 142; 172/762, 763, 271, 644, 699, 704, 719, 713, 721, 724, 725, 730, 747, 749, 750, 753, 762, 763, 736, 737, 410, 765, 769, 770, 772; 175/374, 410; 299/36, 91, 92, 94

[56] References Cited

U.S. PATENT DOCUMENTS

| | | | |
|---|---|---|---|
| 1,188,480 | 6/1916 | Pemberton | 37/142 R |
| 1,507,697 | 9/1924 | Crane | 37/142 R |
| 1,856,930 | 5/1932 | Robin | 37/142 R |
| 1,992,591 | 2/1935 | Whisler | 37/142 R |
| 2,032,875 | 3/1936 | Graham | 37/142 R |
| 2,222,071 | 11/1940 | Gustafson | 172/762 |
| 3,026,947 | 3/1962 | Larsen et al. | 172/762 |
| 3,085,635 | 4/1963 | Livermore | 37/142 R |
| 3,312,504 | 4/1967 | Makinen | 172/762 X |
| 3,659,654 | 5/1972 | Davies et al. | 172/699 |
| 3,897,647 | 8/1975 | Helton et al. | 172/713 |
| 3,919,792 | 11/1975 | Hahn et al. | 37/142 R |
| 3,932,952 | 1/1976 | Helton et al. | 172/747 X |
| 4,357,765 | 11/1982 | Seykora | 37/142 R |
| 4,625,810 | 12/1986 | Edmisson | 172/747 X |

FOREIGN PATENT DOCUMENTS

| | | | |
|---|---|---|---|
| 800130 | 8/1958 | United Kingdom | 37/142 R |
| 2051184 | 1/1981 | United Kingdom | 37/142 R |

*Primary Examiner*—James R. Feyrer

*Attorney, Agent, or Firm*—Wood, Dalton, Phillips, Mason & Rowe

[57] ABSTRACT

An improved digging point assembly comprises a holder, a blade member and a digging tip member connected in series. The blade member is constructed such that, when partially worn, it can be used as a tip member on a fresh blade member. The tip can be allowed to wera out completely and the blade can also be allowed to wear until damage to the holder is imminent. The worn blade member is then used as a tip on a fresh blade member, and the cycle repeated.

9 Claims, 3 Drawing Sheets

DIGGING POINT ASSEMBLY

BACKGROUND OF THE INVENTION

1. Technical Field

The present invention relates to a novel digging point assembly and to blade and tip members used in said digging.

2. Description of the Prior Art

The digging point or tip member of a ripping tyne implement is subject to considerable wear at the forward end of the ripping tyne. Replaceable points or tips have therefore been used to increase the effective life of the ripping tyne and to protect that section of the tyne to which they are attached. The known point or tip is of such shape as to allow for considerable wear and also to maintain a reasonable cutting edge. However, once the digging point has worn to a stage where damage to the tyne is imminent, the point must be discarded to avoid any wear or damage to the tyne. Thus, a considerable proportion of the digging point or tip is not utilised.

To increase the operating life of such a replaceable point, the material of the point has sometimes been made more massive. However, the extra mass of material tends to round off in use and decreases the digging ability of the implement.

It is an object of the present invention to overcome or substantially ameliorate the above described disadvantages by providing a digging point assembly in which the digging points are utilised most effectively and efficiently.

SUMMARY OF THE INVENTION

According to one aspect of the present invention, there is provided a blade member for a digging point assembly, said blade member having front and rear ends defined with respect to the direction of travel in use, said front and rear ends being of matingly compatible configuration, whereby the blade member may couple to another such member acting as a digging tip.

According to another aspect of the invention, there is also provided a digging point assembly comprising a holder adapted to be fixed to a tyne or similar portion of an agricultural ripping implement, a blade member as described in the preceding paragraph, said holder being adapted to receive the rear end of said blade member, and a tip member connectable to the front of said blade member.

An important feature of the invention is that the blade members are of such configuration that they can be connected in series. In this manner, a worn blade member can be used as the digging tip connected to a fresh blade member. The digging tip can be allowed to wear out completely and the blade member can also be allowed to wear out until the damage to the holder is imminent. At that point, the worn blade member is removed, a fresh blade member is inserted in the holder, and the worn blade member is inserted in the fresh blade member and used as a digging tip. The cycle is then repeated as required.

The holder, blade member and digging tip can be made of any suitable material and by any suitable method known to those skilled in the art.

BRIEF DESCRIPTION OF THE DRAWINGS

A preferred embodiment of the invention will now be described with reference to the drawings in which.

DESCRIPTION OF THE PREFERRED EMBODIMENT

Figure 1:
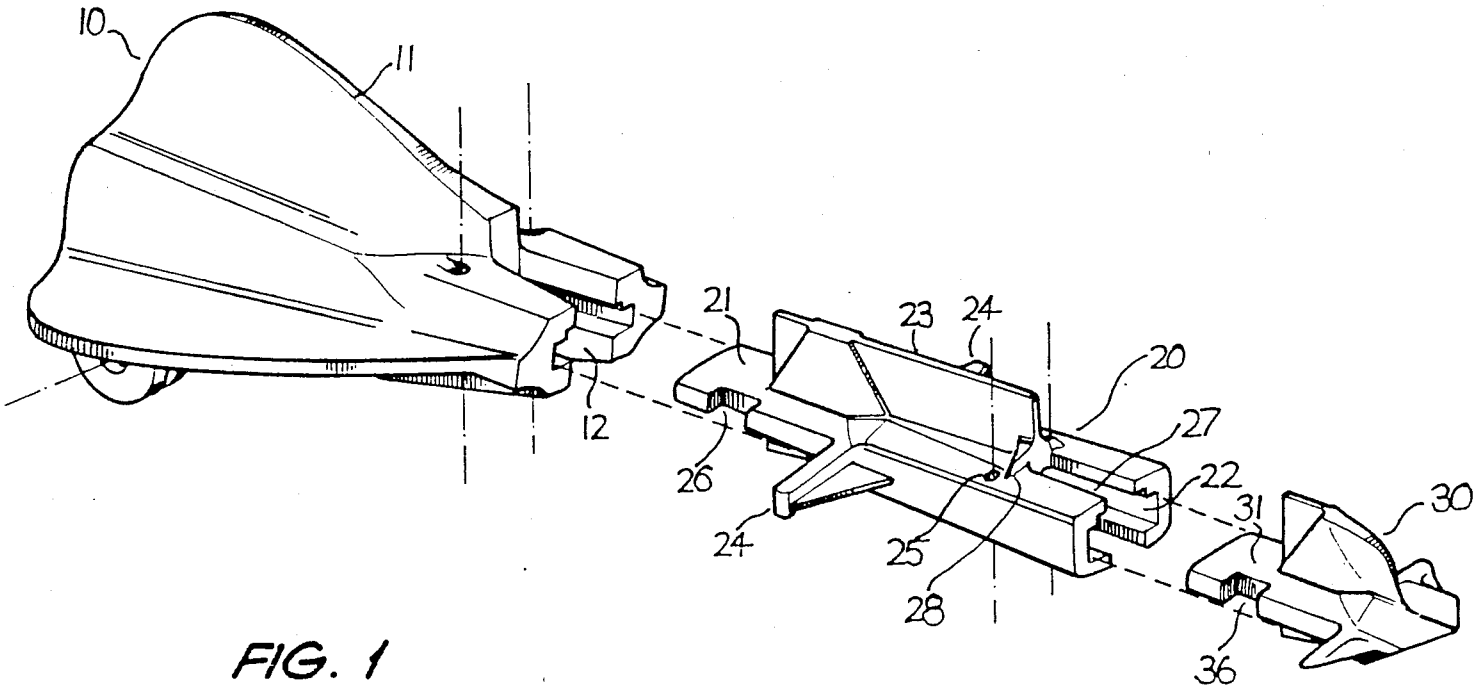
FIG. 1 is a perspective exploded view of the digging point assembly of the preferred embodiment.

As shown in FIG. 1, the digging point assembly comprises a holder 10 which, in use, is connected to the working end of a tyne of a ripping implement. The holder 10 has a female front end 12 which receives a mating male end 21 of a blade member 20. The other end 22 of the blade member 20 is a female end comprising a socket and matingly compatible with the male end 21 so that a number of blade members can be connected in series. In use, the front end 22 of the blade member 20 receives a male end 31 comprising a tongue of a digging point or tip member 30. The tip member 30 shown in FIG. 1 is, in fact, a worn blade member as explained below.

In use, the digging point assembly illustrated in FIG. 1 would be subject to considerable wear on the leading end. Since the tip member 30 is held in the front end of the blade member 20, as the tip member 30 wears, the front end of the blade member 20 will also begin to wear. In time, the tip member 30 will wear out completely and the blade member will wear back to a point where damage to the holder 10 is imminent. At this point, the worn blade member 20 is removed from the socket 12 of the holder and a fresh blade member is inserted intermediate the holder 10 and the worn blade member 20 which is now used as a tip member. The cycle is then repeated. It will be apparent to those skilled in the art that the described digging point assembly avoids any wastage of material since the digging point members are used up entirely.

The blade member 20 comprises a length of suitable material having a front female end 22 and a rear male end 21. A vertical fin portion 23 is provided along the top side of the blade member. Wings 24 are also provided on opposite sides of the blade member. A hole 25 can also be provided in the female end portion to receive a wire which also passes through recess 36 of the male portion of the tip member 30 to prevent the tip from coming out of the blade socket 22. Typically, the male and female ends are tapered to provide a self-locking effect.

Figure 2:
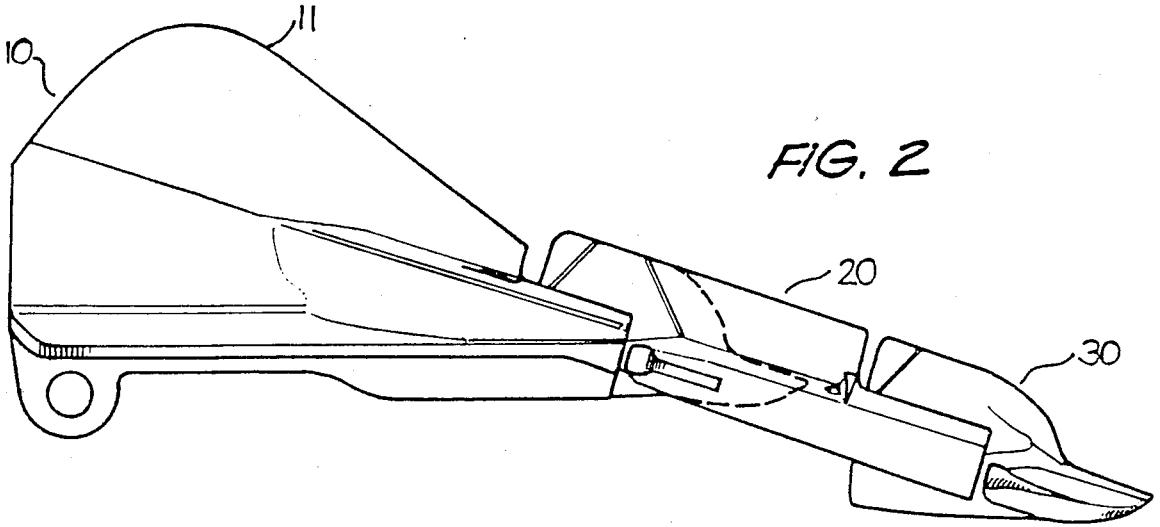
FIG. 2 is a side elevational view of the digging point assembly of FIG. 1.
Figure 3:
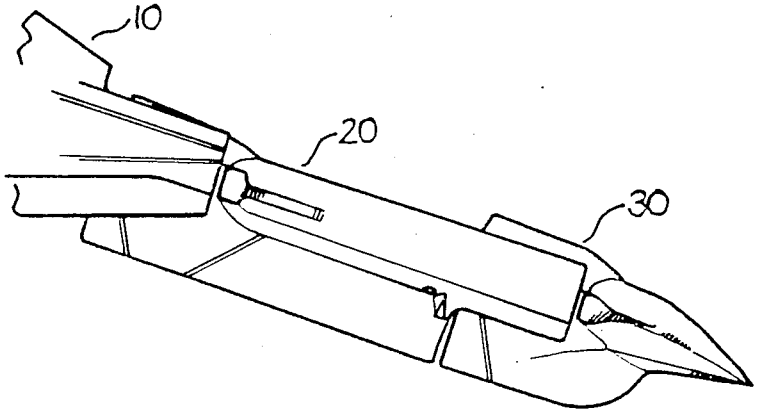
FIG. 3 is a partial side view of the digging point assembly of FIG. 1 with blade and tip members reversed.

The design of the blade member 20 incorporates some particularly advantageous features. First, the blade 20 can be inverted and still mate with the holder 10 and tip member 30. Since the tip member 30 is a worn blade, it follows that the tip member can also be inverted. FIG. 2 illustrates the blade and tip members in a conventional configuration while FIG. 3 illustrates the blade and tip members in the inverted configuration. This feature allows various configurations of the blade and tip members, and hence different digging characteristics, to be obtained. The tip member can be turned over to change the actual contact angle on the most forward contact point with the ground. It has been found that a heel often is formed on the bottom of the tip making it more difficult for the tip to dig into the ground. By turning the tip over, a new and sharp cutting edge is obtained. The ability to invert the blade member 20 is also an advantage in controlling the flow of earth after the initial and most forward digging point has performed its function. By inverting any one or more of the three components in the digging point assembly, the optimum configuration and digging characteristics can be obtained.

The fin 23 on the blade member 20 is displaced rearwardly to reinforce the weakened section where the blade changes from a female section to a male section. A recess 27 is provided in the female portion 22 to accept the displaced vertical fin. The digging ability of points of this nature is to a certain extent a function of their vertical thickness. As mentioned above, a heel often forms on the underside of the wearing point and hinders its penetration into the ground. By overlapping the vertical fins between the digging tip 30 and the blade 20, it is possible to keep the combination relatively thin while enhancing the digging characteristics and maintaining strength.

The wings 24 on the blade member 20 are tapered towards the front to permit a narrower digging point at the working end while protecting a wider and more solidly constructed holder 10 at the rear. Moreover, each wing is designed to protect the holder for the first part of the its working life and, when the worn blade member is then used as the tip member, the wings will wear away quickly. As shown in the drawings, the wings 24 are designed with thickened trailing edges which makes the wing tips wear faster when closer to the digging point. This design has a two-fold advantage. First, the wings will provide more secure protection for the holder 10 during the first part of their working life. Secondly, when the worn blade member is used as a tip member and the wings are driven deeper into the ground, they wear away quickly and avoid hooking onto stumps when the plough is lifted from the ground.

Figure 4:
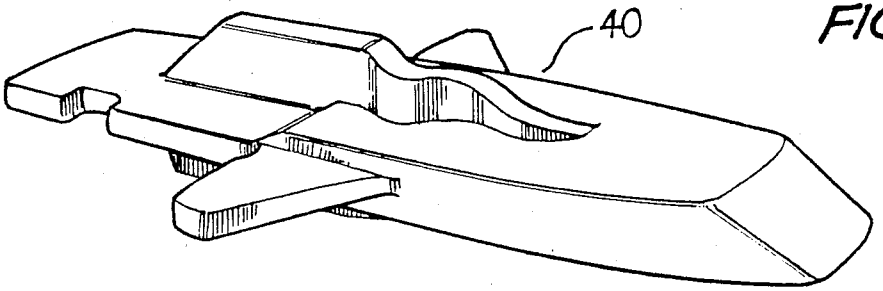
FIG. 4 is a perspective view of a tyne member suitable for use with the digging point assembly of FIG. 1.
Figure 5:
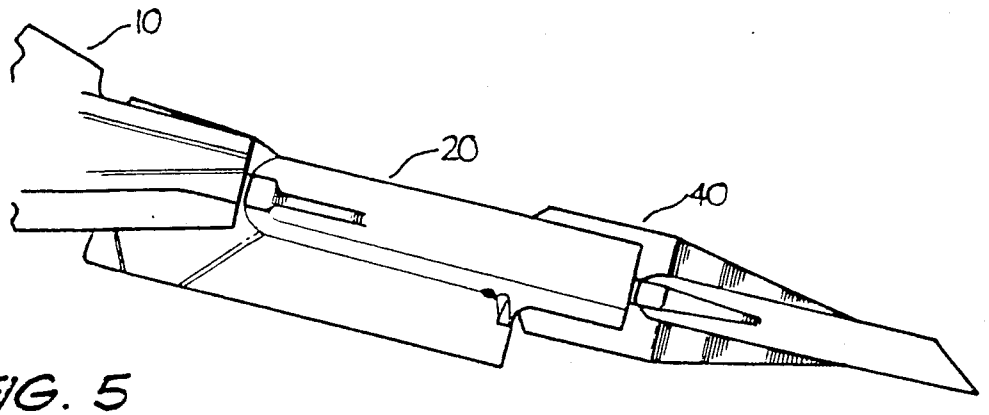
FIG. 5 is a side view corresponding to FIG. 3, but with the tip member illustrated in FIG. 4.

An alternative digging tip member 40 is illustrated in FIG. 4. The digging tip 40 is made of a more brittle but harder wearing material and is particularly advantageous when used with the stronger, tougher but less wear resistant blade member 20 since the characteristics of both materials are better utilised. Preferably, the harder wearing tip 40 is wider than the blade member 20 holding it so that when the combination wears the leading hard tip protects the softer supporting member 20. In known digging point assemblies where hard tips have been inserted directly into the holders, the tips have tended to fracture when they were worn very thin. By using the hard tip member in combination with the tough blade member 20, a highly wear resistant assembly is obtained yet the holder 10 is protected by the tough blade member 20.

The thickness of the vertical fin 23 tapers towards the front to deliberately wear faster to thereby maintain a sharp digging point unimpaired by a vertical fin. Recessing the vertical fin back from the digging point allows the soil to be split, thereby reducing horse power requirements and producing an enhanced shattering effect in the soil.

The holder 10 is also provided with a vertical fin 11 on its top side, the fin 11 acting as an extension of the fins on the blade and tip members.

Preferably, the components of the digging point assembly are all of concave shape on their undersides. The concave shape produces a self-sharpening effect.

It is also advantageous to provide a fluted vertical reinforcing fin on the underside of the blade and tip members. Although a fin on the underside may facilitate the formation of a long heel tending to hinder the tip entering the ground, the fluted design increases the wear of such a fin on the underside of the tip, and the combination of increased wear and added sharpness more than compensates for the negative characteristics of the heel formation. The fluted fins thus provide structural reinforcement and vertical earth splitting action but, when inverted, do not allow the formation of a penetration hindering heel.

Preferably, the thickness taper on the blade member is approximately 4°, and the width taper is approximately 8°. It has been found that the 4° taper is self-locking whilst the 8° taper is not. The combination of the two tapers has the advantage that the blade member 20 will lock into the holder 10 upon insertion, but is easily removable by wiggling it sideways, i.e. in the same plane as the 8° taper, where the 4° locking taper has the least effect. Similarly, the top member 30 is locked upon insertion into the blade membeer 20 by the 4° taper, but can be removed by sideways movement along the 8° taper.

To ensure that the digging tip 30 is not dislodged from the blade member 20, a wire can be inserted through hole 25 of the blade member 20 and recess 36 of the tip 30 when inserted in the blade member. A recess 36 is provided in the male portion 31 of the tip 30 so that the self-locking taper will operate over a range of fits without the wire or shear pin restricting the taper lock action.

To protect the wire shear pins, a protective wall 28 is provided in front of the wire hole 25. Alternatively, the top of the hole can be elongated rearwardly to allow the wire to lay back and be protected from wear.

The foregoing describes only some embodiments of the present invention, and modifications which are obvious to those skilled in the art may be made thereto without departing from the scope of the invention. For example, although the blade member 20 has a leading female end and trailing male end, the design of the components of the digging point assembly may be altered so that the male end is foremost.

I claim:

1. In a digging point assembly of the type comprising a holder adapted to be fixed to a tyne of an earth working implement and a digging point tip member, the improvement comprising an elongate blade member adapted to be connected between said holder and said tip member, said blade member having a female front end and a male rear end defined with respect to the operative direction of motion, said front and rear ends being of mating configuration whereby said blade member can receive at the front end thereof another such blade member to function as the tip member for said digging point assembly.

2. A digging point assembly for an earth working implement, said assembly comprising:

a holder adapted to be fixed to a tyne of said implement, said holder having a female front end defined with respect to the operative direction of motion;

an elongated blade member having a male rear end received within the female front end of said holder and a female front end, said front and rear ends of said blade member being of mating configuration; and a tip member having a male rear end received within the female front end of said blade member, said tip member being formed by a blade member.

3. A digging point assembly as claimed in claim 2, wherein said female end of said blade member comprises a socket, and said male end of said tip member comprises a tongue whose free end is wholly received within said socket.

4. A digging point assembly a claimed in claim 3, wherein said tongue and socket have complimentary non-locking tapers in their width and complimentary self-locking tapers in their thickness.

5. A digging point assembly as claimed in claim 2, wherein said blade member has a generally rectangular cross-section and is provided with an upstanding longitudinal fin on the top side thereof.

6. A digging point assembly as claimed in claim 5, wherein the lateral thickness of said fin is tapered towards the leading end.

7. A digging point assembly as claimed in claim 2, wherein said blade member has a generally rectangular cross-section, further comprising a wing portion on each lateral side of the blade member, said wing portion having a width tapering towards the front, and being of greater thickness at the rear thereof.

8. A digging point assembly as claimed in claim 2, wherein the rear end of the tip member is matingly compatible with the front end of said blade member in both normal and inverted orientations.

9. A digging point assembly as claimed in claim 2 wherein the blade member and tip member have concave undersides.

* * * * *